US011339524B2

(12) United States Patent
Patri et al.

(10) Patent No.: US 11,339,524 B2
(45) Date of Patent: May 24, 2022

(54) TOP LOADING WASHING MACHINE INCLUDING WATER LEVEL SENSOR CONTROL

(71) Applicant: Alliance Laundry Systems LLC, Ripon, WI (US)

(72) Inventors: Benjamin Robert Patri, Hortonville, WI (US); Jeffrey Robert Hochtritt, Neenah, WI (US); Wayne Michael Sharkey, Ripon, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 435 days.

(21) Appl. No.: 16/149,851

(22) Filed: Oct. 2, 2018

(65) Prior Publication Data

US 2020/0102690 A1 Apr. 2, 2020

(51) Int. Cl.

| | |
|---|---|
| ***D06F 23/04*** | (2006.01) |
| ***D06F 33/00*** | (2020.01) |
| ***D06F 39/08*** | (2006.01) |
| *D06F 103/18* | (2020.01) |
| *D06F 105/02* | (2020.01) |
| *D06F 105/08* | (2020.01) |

(52) U.S. Cl.

CPC ..... *D06F 39/087* (2013.01); *D06F 23/04* (2013.01); *D06F 33/00* (2013.01); *D06F 2103/18* (2020.02); *D06F 2105/02* (2020.02); *D06F 2105/08* (2020.02)

(58) Field of Classification Search

None

See application file for complete search history.

(56) References Cited

U.S. PATENT DOCUMENTS

2004/0261468 A1 12/2004 Lueckenbach
2006/0000030 A1* 1/2006 Shaffer ..... D06F 35/006 8/159
2008/0172804 A1 7/2008 Vanhazebrouck et al.

FOREIGN PATENT DOCUMENTS

EP 1245714 A2 10/2002

OTHER PUBLICATIONS

European Patent Office, International Search Report and Written Opinion in corresponding International Application No. PCT/US2019/054228 dated Dec. 11, 2019 (11 pages).

* cited by examiner

*Primary Examiner* — Levon J Shahinian
(74) *Attorney, Agent, or Firm* — Leydig, Voit & Mayer Ltd.

(57) ABSTRACT

A washing machine and method for operating the washing machine based upon sensed air pressure arising from filling a wash basin of the washing machine with water during a wash cycle.

6 Claims, 4 Drawing Sheets

TOP LOADING WASHING MACHINE INCLUDING WATER LEVEL SENSOR CONTROL

FIELD OF THE DISCLOSURE

The present disclosure is applicable to machines for washing fabric articles and, more particularly, to top-loading machines including a pressure sensor-based water level control.

BACKGROUND OF THE INVENTION

Known machines for washing fabric items, or washing machines, typically include one or more user-selectable parameters such as water level, which the user can select depending on the size of a load and also on the type of fabric that the articles to be washed are made. While there are certain efficiencies to be realized when allowing the user to select the level of water in the machine, the user's estimations may not always be accurate, which can result in inefficient washing cycles that use either too much or too little water for the type and size of load present in the machine.

A pressure sensor-based approach to gauging water level is currently incorporated into top loading washing machines. In such arrangements (see FIG. 1 described herein below), water partially fills an inlet of a sensor assembly thereafter exerts a compressive force within a tube connecting the inlet to a pressure sensor. When air within connecting tube is allowed to escape, increases in water level within the wash tub result in corresponding increases of the water level within the connecting tube. In a worst case scenario, the air leak is so large that no water level differential is established between the level in the wash tub and the level of water in the connecting tube. The washing machine controller interprets an absence of a sensed water level difference as an empty wash tub, which can lead to overfilling/overflowing the wash basin during a fill.

BRIEF SUMMARY OF THE DISCLOSURE

The present disclosure relates to a system and method for controlling filling the wash basin of a clothes or fabrics washer and, more particularly, to a system and method for ensuring that a pressure-based water level sensor assembly accurately measures a current water level of a washing machine. In particular, the present disclosure is directed to a top-loading washing machine for washing fabric articles. The top-loading washing machine includes a chassis, a wash basin adapted to accommodate therein a load, the load comprising one or more fabric items suspended in water, a water inlet valve adapted to allow water from a supply to be added to the load, a motor associated with the chassis and operably connected with the wash basin, to rotate the wash basin. The washing machine is further configured with a pressure sensor assembly comprising a tube and a pressure sensor configured to sense an air pressure in the tube, and the pressure sensor assembly is configured to generate a water level/pressure signal in accordance with an pressure within tube arising from filling the wash basin with water.

Moreover, the washing machine includes a programmed controller configured to carry out, in accordance with computer-executable instructions stored on a non-transitory computer-readable medium, a method for implementing a pressure-sensor based water level control. The method includes: reading a current water level/pressure value that is based upon the water level/pressure signal provided by the pressure sensor assembly; determining a difference value between an initial water level/pressure value and the current water level/pressure value; and conditionally performing an exception-based wash basin draining step during a wash cycle if the difference value indicates a decrease in water/pressure level that exceeds a water level/pressure drop threshold.

In accordance with a further aspect of a particular aspect of the disclosure, the method for implementing a pressure-sensor based water level control further comprises setting a water level/pressure drop flag if the difference value indicates a decrease in water/pressure level that exceeds a water level/pressure drop threshold.

In accordance with another aspect, the method for implementing a pressure-sensor based water level control is conditionally carried out in response to the machine operating in a non-active state taken from the group of states consisting of: a soak step state; and a stopped cycle state.

In accordance with yet another further aspect, the reading a current water level/pressure value is performed after a load settling wait period.

In accordance with another aspect the water level/pressure drop threshold is on the order of a one inch water pressure difference.

In accordance with yet a further aspect, the programmed controller is configured to receive the water level/pressure signal generated by the pressure sensor assembly and generate a filtered current water level level/pressure signal based upon a stream of values from the water level/pressure signal.

The above-summarized disclosure is further presented in the context of a method and a non-transitory computer-readable medium including computer-executable instructions for carrying out the method.

BRIEF DESCRIPTION OF THE DRAWINGS

While the appended claims set forth the features of the present invention with particularity, the invention and its advantages are best understood from the following detailed description taken in conjunction with the accompanying drawings, of which:

DETAILED DESCRIPTION OF THE INVENTION

The present disclosure is applicable to top-loading machines for washing clothes and other fabric articles. Such machines typically carry out more than one operation in succession in a washing cycle including, for example, a pre-soak operation, a washing operation and one or more rinsing operations. Each cycle requires the machine to fill a wash basin, into which the fabric items are placed, with water. Additionally, a machine wash cycle may be interrupted after a wash basin of the washing machine has been filled. During such interruptions of washing cycles, a water level within the basin (and thus a sensed water pressure associated with a basin's contents) should remain constant as long as no filling/draining is occurring.

However, a pressure sensor-based water level control arrangement of the type described, by way of example, herein may lose calibration when water is allowed to remain for a substantial amount of time in the basin (e.g. during a soak period or a washing cycle is interrupted with the basin is filled with water). The loss of calibration in such instances causes the controller to register a lower than actual level of liquid in the wash basin. Such loss of calibration (i.e. the controller carrying out a basin fill operation on a non-empty wash basin based upon a sensed "empty" wash basin) may lead to overflowing the wash basin during a subsequent fill cycle of the washing machine.

Figure 1:
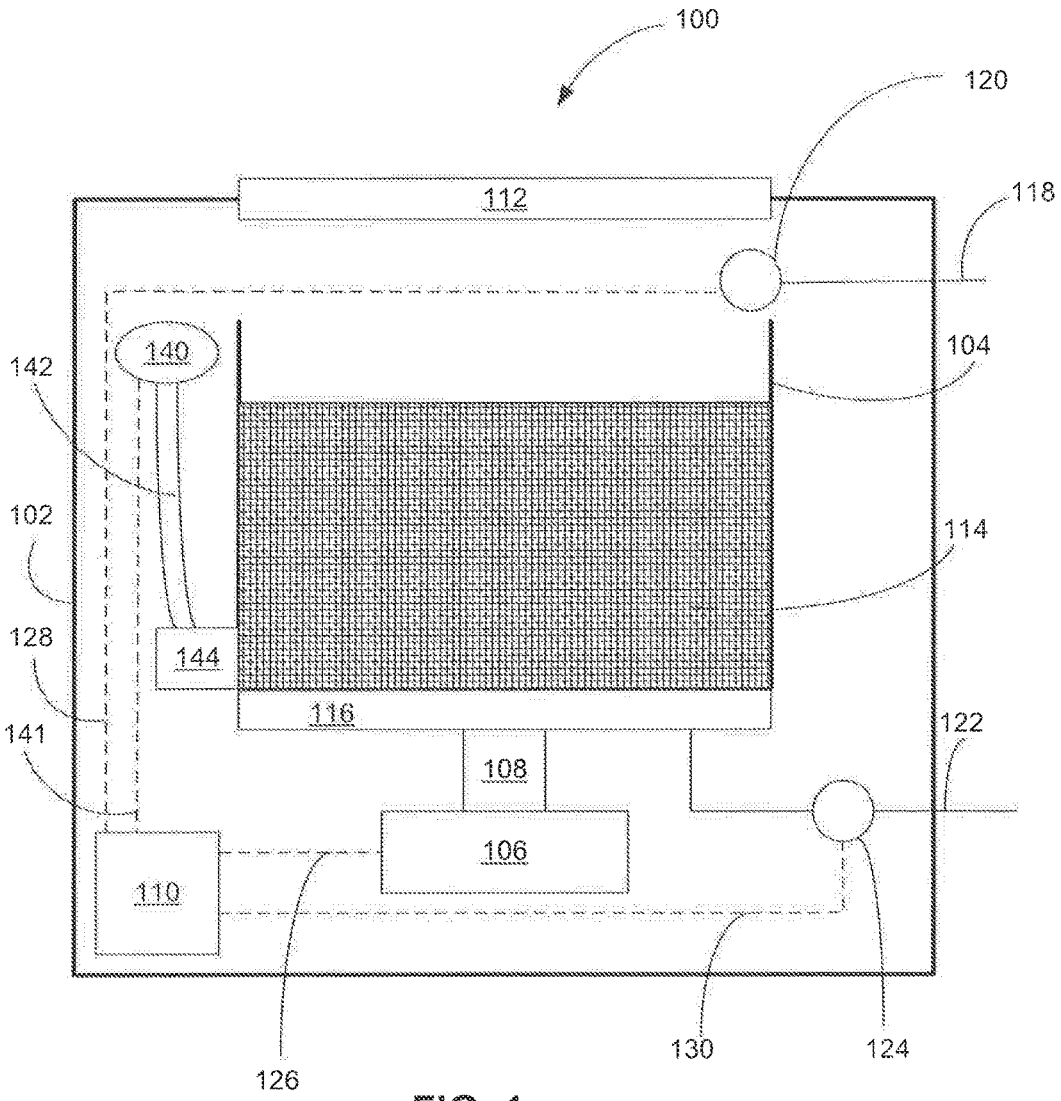
FIG. 1 is a schematic representation of a washing machine including a controller that executes monitoring and control logic in accordance with the disclosure.

Turning to FIG. 1, a top-loading washing machine 100 is schematically shown to illustrate various components that may be relevant to the present disclosure, but it should be appreciated that the illustratively depicted systems and methods have broad applicability to various other machine types that may be different than the top-loading washing machine 100 illustratively depicted in FIG. 1. The top-loading washing machine 100 includes a chassis 102 that encloses a wash basin 104. The wash basin 104 is rotatably supported in the chassis 102 and is associated with an electric motor 106 through a transmission 108. The electric motor 106 is mounted on the chassis 102. During operation, the motor 106 receives power and command signals via line 126 indicating the direction and torque that is applied to rotate the wash basin 104 from a controller 110. The transmission 108 may be omitted.

The controller 110, which may be a standalone controller or a controller that cooperates with other controllers to control operation of various functions of the machine 100, is, for example, a programmable logic controller capable of executing computer executable instructions. The wash basin 104, which in the illustrated embodiment is open on the top, is accessible through a door 112 of the chassis 102 and is arranged for a top-loading configuration, meaning, fabric items are inserted in the basin and removed from the basin after being washed from the top of the machine 100. It should be appreciated, however, that the systems and method described herein may also be applicable for front-loading machine configurations.

In the embodiment shown in FIG. 1, the wash basin 104 is loaded with contents 114 that include a load of laundry and water. Upon completion of a fill stage, the contents 114 fill the wash basin 104 to a desired/operating height. At which point, the machine 100 may operate in any of a variety of modes (agitation, soak, pause, etc.). During operation of the machine 100 the contents 114 of the wash basin 104 are agitated by an agitator arrangement 116. For adding water to the wash basin 104, a water inlet 118 is connected to a supply of water (not shown) and includes a control valve 120 that meters the water added to the wash basin 104 and is responsive to command signals from the controller 110 via line 128. In a known fashion, more than one water supply can be used, for example, for supplying hot and cold water to the wash basin. Similarly, water is drained from the wash basin 104 through a water drain 122 that includes a flow control 124 that is responsive to control signals from the controller 110 via line 130. The flow control 124 may include a valve to meter or control the flow of water drained from the wash basin 104, and may further include a pump or other actuator operating to draw water from the wash basin 104.

The controller 110 communicates with various systems and actuators during operation of the machine 100 to receive and process information indicative of machine operating parameters and to also send command signals to the various actuators that carry out operations of the machine. For example, the controller 110 communicates with the motor 106 and/or the transmission 108 through the line 126. The controller 110 further communicates with the water inlet valve 120 through the line 128 and also with the water drain flow control 124 through the line 130.

Of particular relevance to the present disclosure, the controller 110 receives a pressure sensor signal from a pressure sensor 140 via a line 141. The pressure sensor 140, by way of example, outputs a pulse having a width that is proportional to the sensed pressure. The controller 110 converts the pulse width to a frequency value. Thereafter, the frequency value is converted, in accordance with a polynomial characterization equation to an "inches of water" value. This raw instantaneous pressure (inches water) value is fed to a digital filter to render a current filtered pressure (in the form of inches water). The above-described sensor signal and value generation scheme is merely exemplary in nature, and a wide variety of pressure sensor signal and value generation schemes are contemplated in various other implementations.

The pressure sensor signal is calibrated to represent the level of the contents 114 (including water and laundry) within the wash basin 104. In the illustrative example, water level is converted to an air pressure, measured by the sensor 140 by allowing a small amount of water to enter the pressure bulb 144. The air within a tube 142 connecting the pressure bulb 144 and the pressure sensor 140 is subject to increasing pressure as the level of the contents 114 increases during filling of the wash basin with water. Thus, in accordance with the illustrative example, the pressure sensor 140 generates an electrical signal on line 141 representing a hydraulic water column pressure of water present in the wash basin 104 (i.e. the height of the contents within the wash basin 104). The controller 110 may automatically instruct a filling of the wash basin when additional water is required, and to also limit the water added to the basin based on the water level signal from the pressure sensor 140, for example, to avoid an overfilling of the basin.

In the past, the above-described arrangement for determining a current water level through the use of the pressure sensor 140 and the tube 142 has presented the potential for a loss of calibration after the wash basin is at least partially filled as a consequence of air leaking from the tube 142 (resulting in liquid rising from the pressure bulb 144 up the tube 142 and a lower sensed pressure by the pressure sensor 140). Thus, the illustratively depicted arrangement and methods for sensing the level of the contents 114 in the wash basin exhibit the potential to become severely out of calibration in the direction of not sensing a high level of the contents 114 in the wash basin 104. In view of this potential problem, a procedure is incorporated into the controller 110 to sense such air leakage/pressure loss to avoid over-filling the wash basin 104 in most cases where air leaks (even at a moderate rate) from the tube 142 while water and laundry are present in the wash basin 104.

Figure 2:
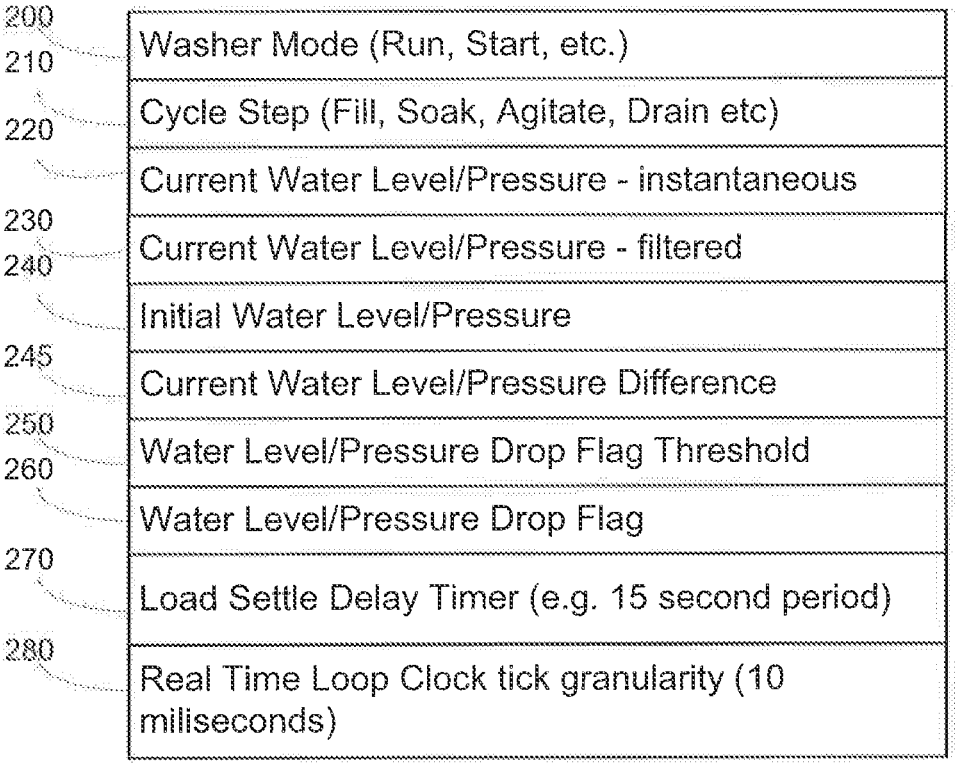
FIG. 2 is a summary of data elements utilized by the monitoring and control logic of the controller during operation of the washing machine.

Turning now to FIG. 2, a set of illustrative data elements are summarized that are utilized by the controller 110 during operation of the washing machine 100 to ensure that, in the event of air leakage from the tube 142, the controller operates the valves 120 and 124 so as not to overfill the wash basin 104 with contents 114 (including water filling the basin via the valve 120). A washer mode 200 indicates current operating state of the machine 100. Examples of the operating states identifiable via the washer mode 200 include: run mode (running a cycle) and start mode (machine on and waiting for user to push a start button to commence running a wash cycle). A cycle step type 210 indicates the current step of a cycle while the machine operates in the run mode. Examples of steps (stages) of the cycle include: fill, soak, agitate, spin, drain, etc.

A current raw water level/pressure signal value 220 stores the current instantaneous pressure sensor measure provided in a signal received by the controller 110 via line 141 from the sensor 140. In the illustrative example, a raw pressure signal is processed every 50 milliseconds. However, the pressure sampling rate/repetition period may vary substantially in various alternative arrangements. In general, the rate should be sufficiently high to provide enough samples such that an accurate filtered measurement can be provided from a relatively noisy input signal (i.e. one for which an instantaneous measurement is likely to vary substantially). A current filtered water level/pressure signal value 230 stores a value rendered by a digital filter (not shown) within the controller 110 that operates upon the stream of the current raw water level/pressure signal value 220. In an illustrative example, the digital filter is configured with a time constant of 1.6 seconds. However, the time constant may be greater/less than 1.6 seconds in alternative cases.

An initial water level/pressure value 240 stores a value representing a level of the contents 114 (i.e. the value of the current filtered water level/pressure value 230) at the time filling the wash basin 104 ended or stopped (e.g., the filling stage completed or interrupted).

A current water level/pressure difference value 245 stores a last difference calculated between the initial water level/pressure value 240 and the current filtered water level/pressure signal value 230.

A water level/pressure drop threshold value 250 stores a value representing an amount of pressure drop (as rendered by the current filtered water level/pressure signal value 230) that will result in setting a water level/pressure drop flag 260. By way of example, the water level difference that will result in setting the water level/pressure drop flag 260 is a pressure drop corresponding to a one inch water level drop in the wash basin 104. However, the difference value may differ in other implementations of the control arrangement described herein. Moreover, the value stored in the water level/pressure drop threshold value 250 may be a static value, a configurable value, or even a dynamically configured value (based upon a history of machine operation), A load settling wait period timer 270 indicates a time that has elapsed while waiting for a load to settle within the wash basin 104. In the illustrative example, the load settling timer 270 measures a configurable time period (e.g., 15 seconds) after: (1) completing an agitation step of a wash cycle, and (2) a wash cycle was stopped while the wash basin 104 is filled and not yet drained. The comparison of the initial water level/pressure value 240 and the current filtered water level/pressure signal value 230 occurs, for example, every 15 seconds.

An operating loop time tick 280 stores an operating system tick granularity for measuring the various time periods for executing operations summarized herein below with reference to FIGS. 3 and 4. By way of example, the operating tick period is 10 milliseconds.

Figure 3:
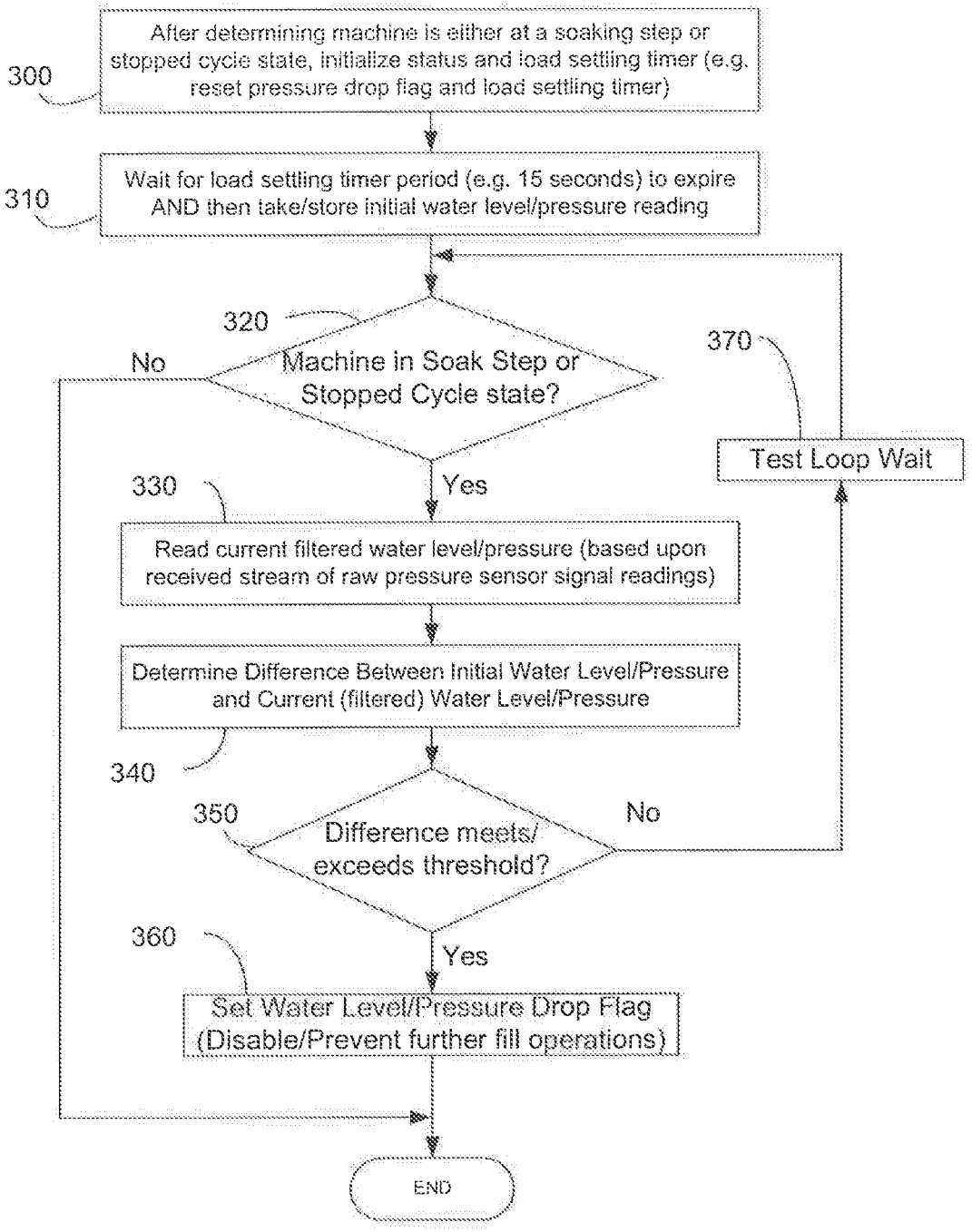
FIG. 3 is a flowchart summarizing operation of the controller logic during particular portions of the operation of a wash cycle (including interruption thereof) to detect a non-expected loss of pressure sensed by a pressure sensor configured to facilitate monitoring a level of contents within a wash basin of the washing machine.
Figure 4:
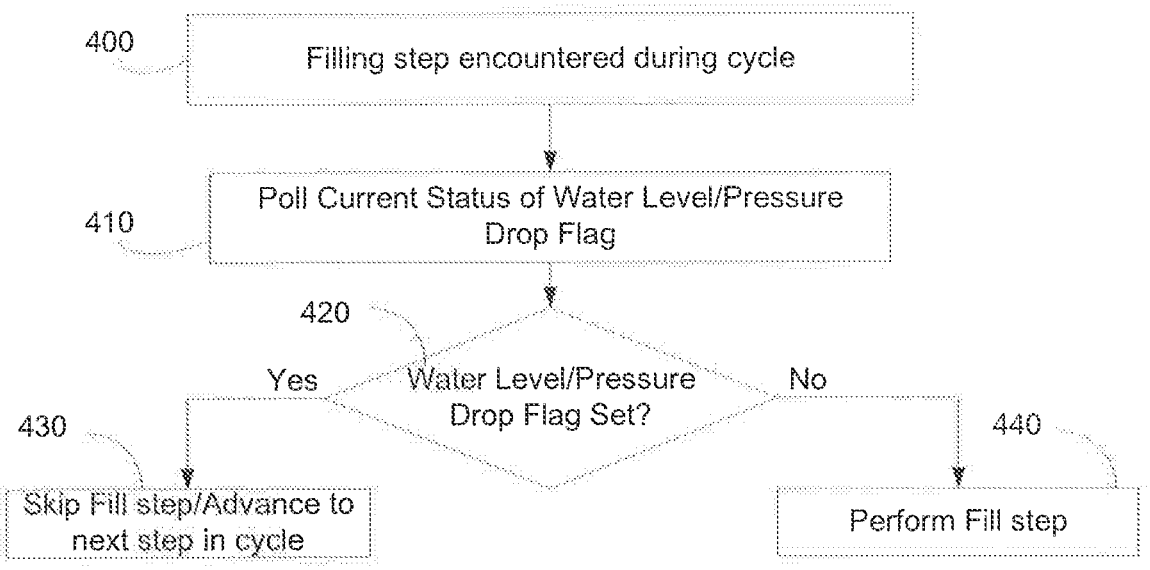
FIG. 4 is a flowchart summarizing operation of the controller logic during a filling step of a wash cycle.

Turning to FIG. 3, a flowchart summarizes decision-making/operation of the controller 110 after determining the machine 100 is either in the "not running" mode (e.g. paused, not running—the user paused operation by selecting a pause button and/or opening the lid 112) or in a soak step/stage while the machine is in the "operating" mode. During 300, the controller 110 initializes status and timer variables including: resetting the water level/pressure drop flag 260 and clearing the load settling timer 270 to zero.

Continuing with the description of the operations summarized in FIG. 3, during 310 the controller initiates and completes a load settling wait period before storing the current filtered water level/pressure value 230 as the initial water level/pressure value 240. By way of example, the controller 110 stores the current filtered water level/pressure value 230 in the initial water level/pressure value 240 when the load settling wait period timer 270 indicates that a configured wait period (e.g., 15 seconds) has expired. The configured wait period of step 310 is commenced, for example, in response to the controller 110 determining that the machine 100 is in: (1) a soak step, or (2) stopped (with the basin 104 filled with water). The wait period for step 310 may be carried out in a variety of ways, and the above description is intended to be merely one example. In other examples, the wait period example of 15 seconds may be shortened, lengthened, and need not even be a fixed value (i.e. an adaptive wait time that is adjusted based upon a rate of change of the value of the filtered water level/pressure value 230. The time may be a count up/down timer. All such variations are contemplated in various implementations of the currently discloses pressure sensor-based control.

Additional operations occur outside the logic summarized in FIG. 3 that also bear upon operation of the controller 110 with regard to the pressure sensing scheme described herein. For example, additional logic is implemented to ensure that pressure/level signal values are increasing at an expected rate during a fill operation. For example, in the event that the tube 142 becomes dislodged from either connecting end, there will not be any sensed pressure change during a fill operation. The controller 110 senses this error by an absence of proper periodic increases and registers a fill pressure error. Additionally, the controller 110 receives and processes (filters) the pressure signal received via line 141 and updates the values for the current raw water level/pressure signal value 220 and the current filtered water level/pressure value 230 according to a sensor sampling repetition period (e.g. 50 milliseconds). The pressure reading and updating period and the processing (e.g. filtering) performed on the received raw pressure signal data stream will vary in accordance with various implementations.

Upon completing the wait period and storing the initial water level/pressure value 240 during step 310, the control passes to step 320 wherein if the machine 100 is not currently in a soak step or a stopped cycle state (with the wash basin 104 in a filled state) control passes to the end. This is because the problem that the current disclosure addresses is the loss of air pressure due to air leaking from the tube 142 while water and soaking fabric fill the wash basin 104 and the contents of the wash basin are not being agitated or spun by the motor 106 of the machine 100. However, at 320 if the machine 100 is currently in a soak step or a stopped cycle state (with the wash basin 104 in a filled state) control passes to step 330.

At 330 the controller 110 reads the current filtered water level/pressure value 230. Thereafter, during 340 the controller 110 determines a difference between the initial water level/pressure value 240 (set during step 310) and the current filtered water level/pressure value 230. During 340 the controller 110 stores the determined difference value in the current water level/pressure difference value 245.

The value for the current filtered water level/pressure value 230 (obtained during step 330) may not represent the actual current water level in the wash basin 104. Specifically, the current filtered water level/pressure value 230 indicates a water level that is lower than the actual water level in cases where air leaks from the tube 142 after setting (during step 310) the initial water level/pressure value 240. Such differences are determined/detected during 340.

During 350, if the current water level/pressure difference value 245 does not meet/exceed the water level/pressure drop flag threshold value 250, then control passes to a wait step 370 where a period of time is allowed to pass before control passes to step 320 described hereinabove—at which point another iteration of conditionally testing for a pressure drop is initiated. The wait period (carried out during 370) between iterations of the loop depicted in FIG. 3 is subject to a wide variety of choices. In one case, the loop is executed at the tick period of the controller 110 set forth in the operating loop time tick 280. However, in view of the relatively slow rate at which air is likely to leak from the tube 142, the wait period for step 370 may be on the order of a second, multiple seconds or even minutes in accordance with various implementations. After the wait period, control passes from step 370 to step 320.

With continued reference to step 350, in the illustrative example, the water level/pressure drop flag threshold value 250 is a pressure corresponding to a one inch water level drop in the wash basin 104. The one inch threshold represents an acceptable error/change level that may be caused by any of a variety of situations—including the aforementioned air leaking from the tube 142. However, other water level/pressure drop thresholds (as well as a variety of ways for setting such threshold value 250) are contemplated for other implementations.

If, during 350, the current water level/pressure difference value 245 meets/exceeds the water level/pressure drop flag threshold value 250, then control passes to 360 where the water level/pressure drop flag 260 is set. The setting of the flag 260 indicates that an error state has been encountered where the pressure sensor 140 may not be accurately measuring the current level of the contents 114 in the wash basin 104. Control then passes to the end.

Setting the water level/pressure drop flag 260 does not necessarily result in an immediate disruption to normal operation of the machine 100. Instead, it merely indicates a need to use care when a next fill operation occurs. By way of example, setting the water level/pressure drop flag 260 precludes any further filling operations until a complete draining operation has been carried out by the machine 100—at which point the controller 110 resets the water level/pressure drop flag 260.

The effect of setting the water level/pressure drop flag 260 upon a subsequently encountered filling step of the machine 100 is described herein below with reference to FIG. 4. During 400, the controller 110 encounters a filling step operation. During 410 the controller 110 polls the current status of the water level/pressure drop flag 260. Next, during 420 if the water level/pressure drop flag 260 is determined to be in the set state, then control passes to 430.

During 430 the controller 110 skips/bypasses the filling operation. A remedial operation, such as performing a complete draining, may be performed immediately during 430. However, in an illustrative example, during 430 the controller 110 takes the less drastic remedial action of advancing to a next step in the machine 100's currently selected wash cycle (e.g. agitation, drain, etc.).

During 420 if the water level/pressure drop flag 260 is determined to be in the not set (i.e. reset) state, then control passes to 440 where the controller 110 causes the machine 100 to carry out a normal filling operation.

Figure 5:
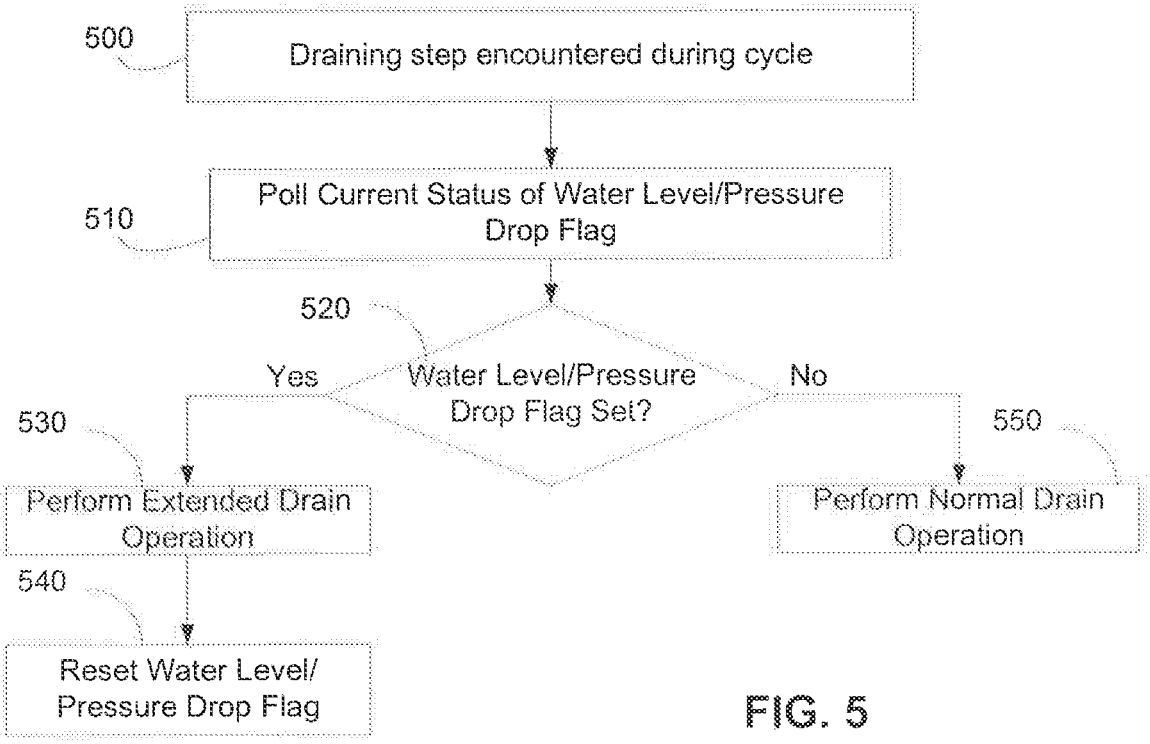
FIG. 5 is a flowchart summarizing operation of the controller logic during a draining step of a wash cycle.

Turning to FIG. 5, a summary is provided of the logic carried out by the controller 110 during a draining operation, based upon the status of the water level/pressure drop flag 260. During 500, the controller 110 encounters a draining step operation. During 510 the controller 110 polls the current status of the water level/pressure drop flag 260. Next, during 520 if the water level/pressure drop flag 260 is determined to be in the set state, then control passes to 530.

During 530 the controller 110 carries out an exception state drain operation wherein the duration of the draining is extended by a specified amount (percentage, number of seconds, etc.) to ensure that any overfilling of the wash basin 104 arising from an air leak in the tube 142 is accounted for (i.e. the wash basin 104 is completely drained). Thereafter, during 540 the controller 110 resets the water level/pressure drop flag 260 (back to the non-exception state). Additionally, in a particular example, a fill automatic recalibration flag (not shown in FIG. 2) is set that will cause the controller 110 to perform a special monitoring operation of a next filling operation to ensure that an accurate fill level is registered by the controller 110 based upon a sequence of pressure sensor signal values provided by the pressure sensor 140 during a next fill step on the machine 100.

During 520 if the water level/pressure drop flag 260 is determined to be in the not set (i.e. reset) state, then control passes to 550 where the controller 110 causes the machine 100 to carry out a normal draining operation.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A top-loading washing machine for washing fabric articles, the top-loading washing machine comprising:

a chassis;

a wash basin adapted to accommodate therein a load, the load comprising one or more fabric items suspended in water;

a water inlet valve adapted to allow water from a supply to be added to the load;

a motor associated with the chassis and operably connected with the wash basin, to rotate the wash basin;

a pressure sensor assembly comprising a tube and a pressure sensor configured to sense an air pressure in the tube, and wherein the pressure sensor assembly is configured to generate a water level/pressure signal in accordance with a pressure within tube arising from filling the wash basin with water; and a programmed controller configured to carry out, in accordance with computer-executable instructions stored on a non-transitory computer-readable medium, a method for implementing a pressure-sensor based water level control comprising:

reading a current water level/pressure value that is based upon the water level/pressure signal provided by the pressure sensor assembly;

determining a difference value between an initial water level/pressure value and the current water level/pressure value; and performing, in accordance with the determining a difference value, an exception-based wash basin draining step during a wash cycle in accordance with determining that the difference value indicates a decrease in water/pressure level that exceeds a water level/pressure drop threshold.

2. The machine of claim 1 wherein the method for implementing a pressure-sensor based water level control further comprises setting a water level/pressure drop flag if the difference value indicates a decrease in water/pressure level that exceeds a water level/pressure drop threshold.

3. The machine of claim 1 wherein the method for implementing a pressure-sensor based water level control is conditionally carried out in response to the machine operating in a non-active state taken from the group of states consisting of:

a soak step state; and a stopped cycle state.

4. The machine of claim 1 wherein the reading a current water level/pressure value is performed after a load settling wait period.

5. The machine of claim 1 wherein the water level/pressure drop threshold is on the order of a one inch water pressure difference.

6. The machine of claim 1 wherein the programmed controller is configured to receive the water level/pressure signal generated by the pressure sensor assembly and generate a filtered current water level level/pressure signal based upon a stream of values from the water level/pressure signal.

* * * * *